US007245217B2

(12) United States Patent
Tsai

(10) Patent No.: US 7,245,217 B2
(45) Date of Patent: Jul. 17, 2007

(54) HAZARD MITIGATION FOR RAILWAY TRACK INTRUSIONS AT TRAIN STATION PLATFORMS

(75) Inventor: John C. Tsai, Saratoga, CA (US)

(73) Assignee: Fibera, Inc., Santa Clara, CA (US)

( * ) Notice: Subject to any disclaimer, the term of this patent is extended or adjusted under 35 U.S.C. 154(b) by 250 days.

(21) Appl. No.: 10/906,801

(22) Filed: Mar. 7, 2005

(65) Prior Publication Data

US 2005/0205718 A1 Sep. 22, 2005

Related U.S. Application Data

(60) Provisional application No. 60/521,190, filed on Mar. 6, 2004.

(51) Int. Cl.
*G08G 1/00* (2006.01)
*G08B 13/00* (2006.01)

(52) U.S. Cl. ..... 340/541; 340/901

(58) Field of Classification Search ..... 340/665, 340/666, 541, 907–932.1, 933, 944, 901–905; 104/307, 27, 28, 18–20; 246/1 R, 1 C, 174, 246/111–117, 473 R, 473, 473.1; 702/33, 702/41–44; 701/300–302, 19, 20; 398/140–172; 177/45

See application file for complete search history.

(56) References Cited

U.S. PATENT DOCUMENTS 4,442,350 A * 4/1984 Rashleigh ..... 250/227.17
4,807,027 A * 2/1989 Muto ..... 348/148
5,056,884 A * 10/1991 Quinlan, Jr. ..... 385/13
5,194,847 A * 3/1993 Taylor et al. ..... 340/557
5,444,885 A * 8/1995 Hanrahan et al. ..... 14/69.5
5,864,304 A * 1/1999 Gerszberg et al. ..... 340/903
5,913,245 A * 6/1999 Grossman ..... 73/800
6,556,927 B1 * 4/2003 Latta ..... 702/41
6,980,108 B1 * 12/2005 Gebbia et al. ..... 340/555
7,042,369 B2 * 5/2006 Hill et al. ..... 340/942
2005/0069325 A1 * 3/2005 Cicchiello et al. ..... 398/122

FOREIGN PATENT DOCUMENTS

DE 3815152 * 11/1989
EP 0875437 A2 * 11/1998

* cited by examiner

*Primary Examiner*—Benjamin C. Lee
*Assistant Examiner*—Jennifer Mehmood
(74) *Attorney, Agent, or Firm*—Raymond E. Roberts; Intellectual Property Law Offices

(57) ABSTRACT

A hazard mitigation system to detect intrusion by an object into a track zone at a train station platform. A structure is provided that includes a fixed foundation and a surface layer that is cushionably placed above the foundation, such that the structure is located in the track zone. At least one sensor is mounted between the surface layer and the foundation. This sensor senses the weight of the object upon the surface layer and provides a sensor signal representative of that weight. A control unit receives the sensor signal, processes it to determine whether the object represents a potential hazard, and, if so generates a warning signal. The sensor can particularly include a strain or pressure gage, or a fiber optic sensor. When a fiber optic sensor is employed, it can particularly include a fiber Bragg grating.

15 Claims, 10 Drawing Sheets

| STEEL COVER PLATE LENGTH (AB) m | STEEL COVER PLATE SAGGING (CD) m | STRETCH | FREQUENCY SHIFT (Hz) |
|---|---|---|---|
| 5 | 5.00E-03 | 2.00E-06 | 4.00E+08 |
| 5 | 4.00E-03 | 1.28E-06 | 2.56E+08 |
| 5 | 3.00E-03 | 7.20E-07 | 1.44E+08 |
| 5 | 2.00E-03 | 3.20E-07 | 6.40E+07 |
| 5 | 1.00E-03 | 8.00E-08 | 1.60E+07 |
| 4 | 5.00E-03 | 3.12E-06 | 6.25E+08 |
| 4 | 4.00E-03 | 2.00E-06 | 4.00E+08 |
| 4 | 3.00E-03 | 1.12E-06 | 2.25E+08 |
| 4 | 2.00E-03 | 5.00E-07 | 1.00E+08 |
| 4 | 1.00E-03 | 1.25E-07 | 2.50E+07 |
| 3 | 5.00E-03 | 5.56E-06 | 1.11E+09 |
| 3 | 4.00E-03 | 3.56E-06 | 7.11E+08 |
| 3 | 3.00E-03 | 2.00E-06 | 4.00E+08 |
| 3 | 2.00E-03 | 8.89E-07 | 1.78E+08 |
| 3 | 1.00E-03 | 2.22E-07 | 4.44E+07 |
| 2 | 5.00E-03 | 1.25E-05 | 2.50E+09 |
| 2 | 4.00E-03 | 8.00E-06 | 1.60E+09 |
| 2 | 3.00E-03 | 4.50E-06 | 9.00E+08 |
| 2 | 2.00E-03 | 2.00E-06 | 4.00E+08 |
| 2 | 1.00E-03 | 5.00E-07 | 1.00E+08 |
| 1 | 5.00E-03 | 5.00E-05 | 1.00E+10 |
| 1 | 4.00E-03 | 3.20E-05 | 6.40E+09 |
| 1 | 3.00E-03 | 1.80E-05 | 3.60E+09 |
| 1 | 2.00E-03 | 8.00E-06 | 1.60E+09 |
| 1 | 1.00E-03 | 2.00E-06 | 4.00E+08 |

Table 1.

108
$\lambda_1, \lambda_2, \ldots, \lambda_n, \ldots, \lambda_x$
108a
$\lambda_n$
Fiber Bragg grating unit (FBG unit 100)
106
102
$\lambda_n$
104
106
$\lambda_1, \lambda_2, \ldots\ldots, \lambda_x$
108b 100
108
$\lambda_1, \lambda_2, \ldots, \lambda_n, \ldots, \lambda_x$
108a
$\lambda_n + \Delta\lambda$
106
102
$\lambda_n + \Delta\lambda$
106
104
108b

HAZARD MITIGATION FOR RAILWAY TRACK INTRUSIONS AT TRAIN STATION PLATFORMS

CROSS-REFERENCE TO RELATED APPLICATIONS

This application claims the benefit of U.S. Provisional Application No. 60/521,190, filed Mar. 6, 2004 and hereby incorporated by reference.

TECHNICAL FIELD

The present invention relates generally to railway safety, and more particularly to such to mitigate the hazard of railway track intrusions at train station platforms.

BACKGROUND ART

Object intrusion on to railway tracks at train station platforms is a major safety concern for governments, the railway and general transportation industries, communities, and common citizens. Many accidents happen around the world each year and many lives are lost in these accidents. Governments, local communities, and railway companies spend millions of dollars each year trying to improve safety at train station platforms, yet to the inventor's knowledge no solution to this need so far is regarded highly enough that it is widely accepted.

Methods such as laser beam scanning, ultrasonic wave reflection, video cameras, etc. have been used for detecting objects at railway track zones. However, none of these provide effective solutions. For example, a common shortcoming for all of these is that the sensitivity and accuracy are greatly reduced during bad weather conditions. In addition, effective video techniques require human observation at all times.

In this invention, the inventor proposes to use sensors (e.g., mechanical/electrical strain gauges, pressure gages, fiber optic fiber Bragg gratings, fiber optic interferometers, etc.) to detect objects that are at a railway track zone. With this approach, the presence of such an object triggers a warning signal that both train station authorities and the engineer of an approaching train can receive visually or via a telecommunications channel at a safe distance, and take appropriate action if the object is not out of the crossing within a safe period of time.

DISCLOSURE OF INVENTION

Accordingly, it is an object of the present invention to provide a system for train station platform hazard mitigation.

Briefly, one preferred embodiment of the present invention is a system for mitigating the potential hazard caused by intrusion of an object into a track zone at a train station platform. A structure is provided that includes a fixed foundation and a surface layer that is cushionably placed above the foundation. This structure is located in the track zone. At least one sensor is mounted between the surface layer and the foundation, to sense the weight of the object upon the surface layer and provide a sensor signal representative of that weight. A provided control unit receives the sensor signal, process it to determine whether the object represents a potential hazard, and, if so, then generates a warning signal.

An advantage of the present invention is that it can detect and report objects that vary considerably in weight, and thus objects that are both themselves put at hazard by a train entering the station platform track zone or objects that put the train at hazard by entering the station platform track zone.

Another advantage of the invention is that it can detect and report objects that are stationary in or moving across the station platform track zone.

Another advantage of the invention is that it may be flexibly configured, to detect overall or localized effects by objects, and it particularly facilitates monitoring multiple crossings or sections of crossings with multiple sensors.

Another advantage of the invention is that the sensors it employs may be robust and made particularly able to withstand and continue to function well in the variety of adverse environments typically encountered at station platform track zones.

And another advantage of the invention is that it may employ fiber optic technology, rendering critical elements of the system irrelevant with respect to creating or being effected by electrical interference, permitting economical optical rather than electrical connection of the key sensor elements in the system, and permitting such connection at considerable distance from ultimate sensor signal processing and warning signal generation elements of the system.

These and other objects and advantages of the present invention will become clear to those skilled in the art in view of the description of the best presently known mode of carrying out the invention and the industrial applicability of the preferred embodiment as described herein and as illustrated in the figures of the drawings.

BRIEF DESCRIPTION OF THE DRAWINGS

The purposes and advantages of the present invention will be apparent from the following detailed description in conjunction with the appended tables and figures of drawings in which:

TABLE 1 shows the results of calculations of frequency shift for various mounted lengths vs. the amount of sagging.

FIGS. 3*a-b* are simplified schematics depicting the structure and operation of a fiber Bragg grating (FBG) unit that can be used in fiber optic sensors in the hazard mitigation system, wherein FIG. 3*a* shows the FBG unit before a force is exerted and FIG. 3*b* shows it after the force is exerted.

In the various figures of the drawings, like references are used to denote like or similar elements or steps.

BEST MODE FOR CARRYING OUT THE INVENTION

Figure 1:
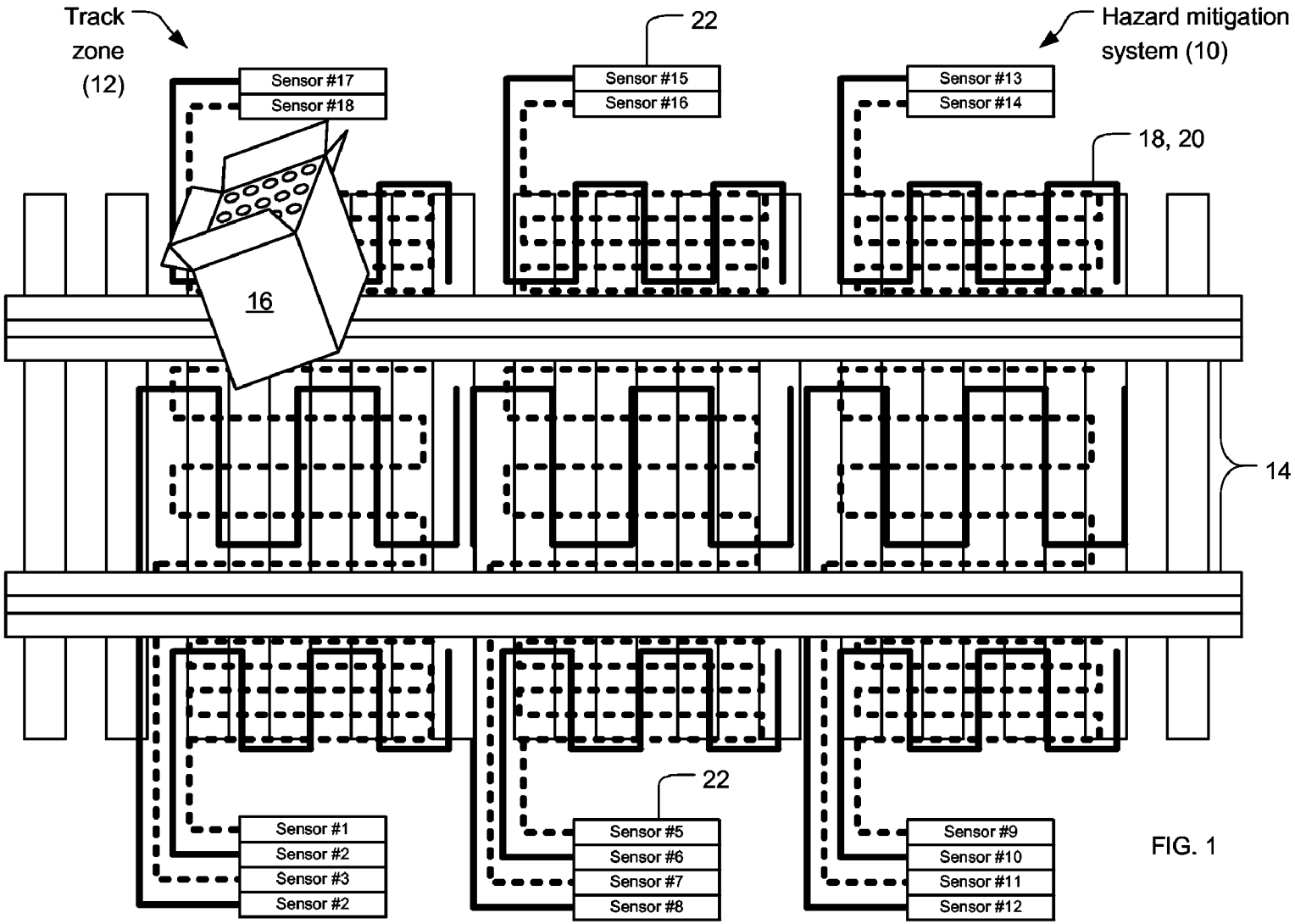
FIG. 1 is a schematic showing basic a configuration of a hazard mitigation system in accord with the current invention.

A preferred embodiment of the present invention is apparatus and methods to mitigate the hazard of railway track intrusions at train station platforms. As illustrated in the various drawings herein, and particularly in the view of FIG. 1, preferred embodiments of the invention are depicted by the general reference character 10.

FIG. 1 is a schematic showing basic a configuration of a hazard mitigation system 10 in accord with the current invention. The hazard mitigation system 10 is used at a railway track zone 12, which may essentially be any area around open railway tracks 14 where it is important to detect whether an object 16 is dangerously close to the tracks 14. For example, it is anticipated that one very likely track zone 12 will be near passenger platforms in railway stations.

The hazard mitigation system 10 in FIG. 1 includes overlapping meshes 18 of wires 20 that are constructed to cover the track zone 12 (but not the actual tracks 14). Each mesh 18 operates a sensor 22 at a terminus of a set of wires 20. The sensors 22 thus monitor the instantaneous strain in the wires 20. When an object 16 falls onto a mesh 18, its weight stretches the wires 20. This wire-stretching is detected by the sensors 22 (here mechanical/electrical strain gauges 22*a*), processed, and a suitable warning signal is then issued.

The location of the sensors 22 in this arrangement is not particularly critical. They can be nearby the tracks 14, or in a train station control room. To improve accuracy, the wires 20 can be of low thermal expansion coefficient material, such as Kovar or Invar. This helps reduce environmental temperature effects, since the weather conditions in a railway system can range widely from day to night, winter to summer, etc. The density of the mesh 18 and the number of them used at each track zone 12 can vary, as straightforward matters of need and design choice.

Figure 9:
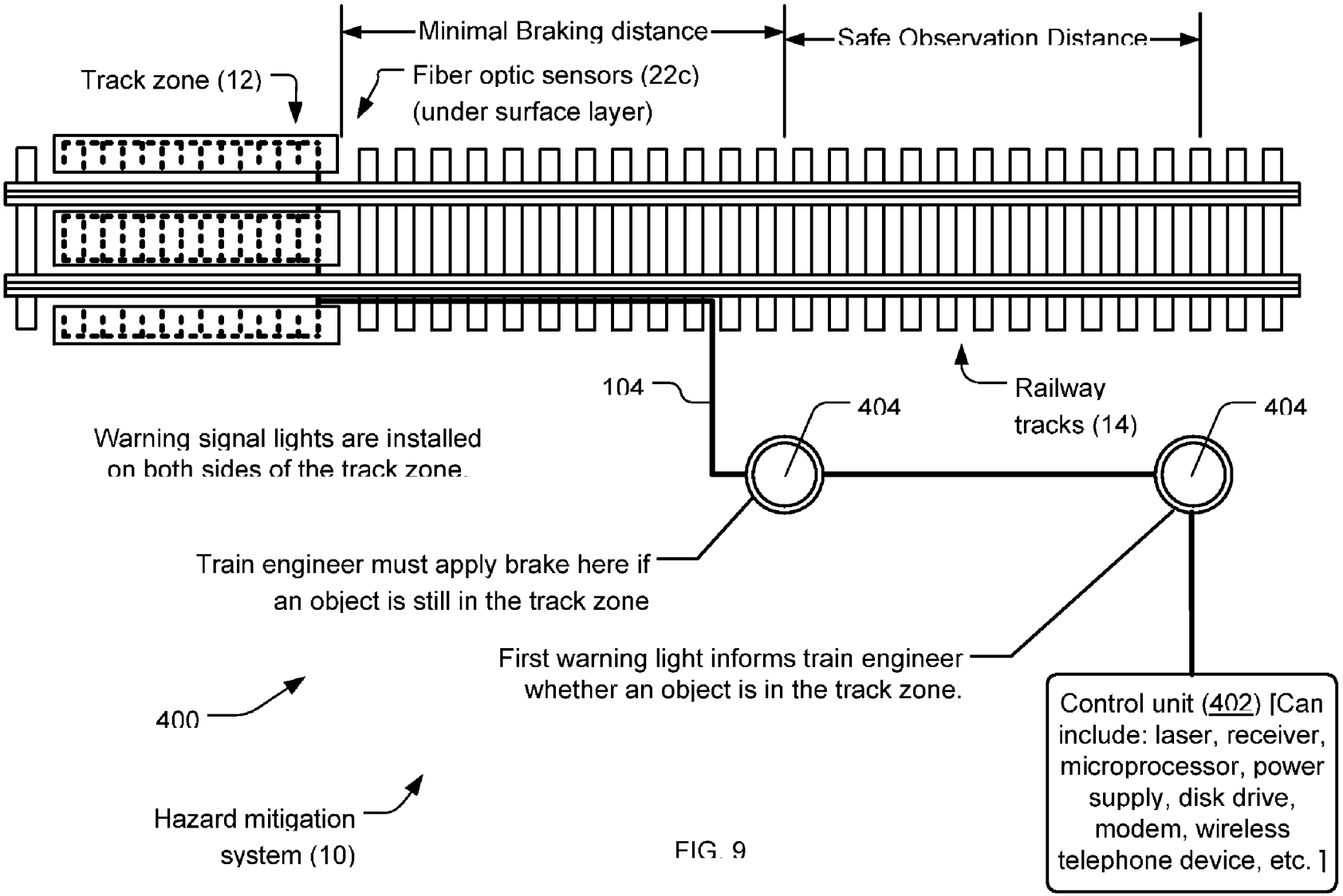
FIG. 9 is a schematic showing a simplified top view of a complete exemplary configuration of the inventive hazard mitigation system.

The signals generated by the sensors 22 are sent to a nearby processor for processing (see e.g., FIG. 9). This can be at any location at the train station, as long as it is reasonably reachable for data access and maintenance. The processor calculates the weight of an object 16 from the strain information received and determines the safety of conditions when a train is approaching. A warning signal is then issued by the processor to the station master and the train engineer if the existence of an object 16 is confirmed and it is determined that it will be jeopardized by or will jeopardize the passage of the train. The use of multiple meshes 18 here can particularly help determine the exact location of the fallen object 16 and permit prompt action with respect to it.

To more effectively cover the track zone 12, one or more covers (e.g., a steel plate or rubber layer; see e.g., FIG. 9) can be used on top of the meshes 18. This can help to detect small objects 16, say, if their size is smaller than the dimensions of the openings in the meshes 18.

Figure 2:
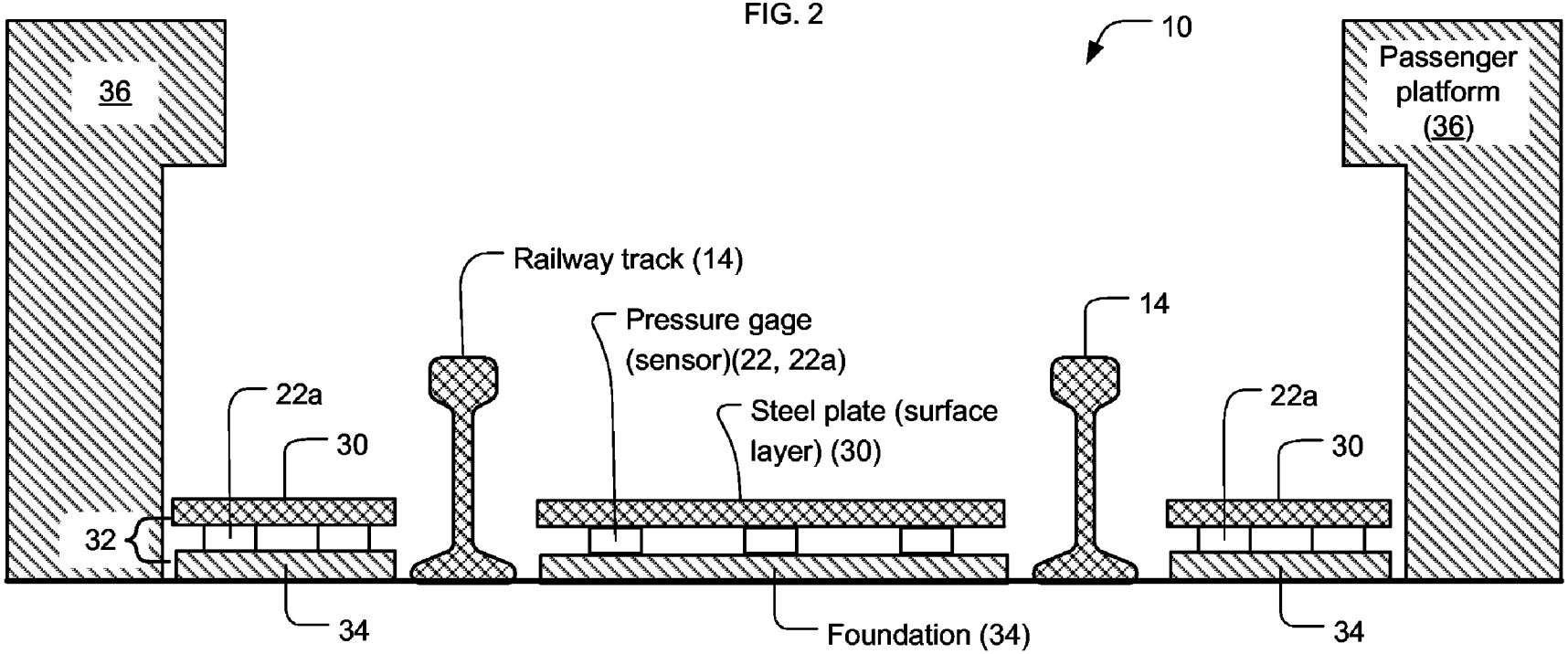
FIG. 2 is a schematic side cross-sectional view of an alternate embodiment of the hazard mitigation system, one particularly using pressure gages as sensors.

FIG. 2 is a schematic side cross-sectional view of an alternate embodiment of the hazard mitigation system 10, one particularly using pressure gages 22*b* as the sensors 22. The overall operational structure here can be viewed as having three layers: a surface layer 30, a detection layer 32, and a foundation 34. A set of railway tracks 14 are also shown, between two passenger platforms 36.

If a strain gauge 22*a* or a pressure gage 22*b* operates electrically (which almost all do), electrical wires are then needed to connect to a power source and to the processor. In general, a minimum of three wires are needed for this: +V, ground, and signal. The quantity of such electrical wiring can be substantial if many such sensors 22 are used. In addition, this may create electrical interference that affects train operation or communications, and electrical systems on a train or otherwise present nearby may create electrical interference that affects signals form these types of sensors 22. In some applications metal type wires 20 can also have disadvantages. They can rust or otherwise corrode due to moisture or the presence of other chemicals. As is discussed below, however, fiber optic sensors are not limited in these respects.

Configurations of the invention using any of the three types of sensors 22 may be applied similarly to ensure that a track zone 12 is cleared when a train is approaching. In view of this similarity, and because those in the railway industry are probably least familiar with fiber optics technology, we have reserved more detailed discussion of exemplary configurations for ones using fiber optic sensors. Other than the sensor technology used, however, the underlying principles and structural considerations are essentially the same for all configurations of the invention, and large portions of the following discussion therefore apply in straightforward manner to all of the configurations. Some additional coverage of non-fiber optic bases systems can be found in co-pending U.S. patent application Ser. No. 10/906,800 (HIGHWAY-RAIL GRADE CROSSING HAZARD MITIGATION) by the present inventor.

I. The Fiber Optic Sensor.

For the following discussion of some example configurations of the inventive hazard mitigation system 10 employing fiber optics technology, the overall mechanism is treated as consisting of three general parts: a fiber optic sensor system; a sensor mounting structure; and a signal generation, propagation, and notification processor.

As noted above, an alternate to a strain gauge 22*a* or a pressure gage 22*b* is a fiber optic sensor 22*c* (FIGS. 3-6). These have light propagated in optical fiber and do not require electricity in signal transmission. In addition, one optical fiber can carry many signals and distribute them to multiple sensors 22. This greatly reduces the quantity of wiring need and eliminates the risk of electrical interference. Another advantage is that optical fiber does not rust or easily degrade in humid environments. In addition, light signals can be multiplexed and de-multiplexed in very convenient ways.

Several types of the fiber optic sensors can be used to monitor for strain in track zone 12. Some examples include the fiber Bragg grating, the fiber optic Fabry-Perot grating, the Mach-Zehnder interferometer, the Fizeau interferometer, and fiber optic Michelson interferometer, etc. All of these fiber optic systems permit comparing optical frequency shift before and after a sensor has encountered a physical dimension change due to the weight of an object 16 being applied to the mesh 18. The mesh material used here can therefore either remain metal wire or be replaced with optical fibers. A cover (e.g., a steel plate, etc.) is then preferably used if optical fibers are used for the meshes 18.

To simplify this discussion, only the example of the fiber Bragg grating (FBG) is used. Once the principles of configurations using that system are grasped, those of ordinary skill in the art should be able to determine when it is appropriate and how to employ the other types of fiber optic sensors. To further simply this discussion, only the scenario of using a steel plate over the top of the mesh is used. Additionally, for the following discussion the fiber optic detection mechanism is treated as consisting of three general parts: the fiber optic sensor and detector; the structure at the railway track zone; and the signal generation, propagation, and notification processor.

Figures 3A, 3B:
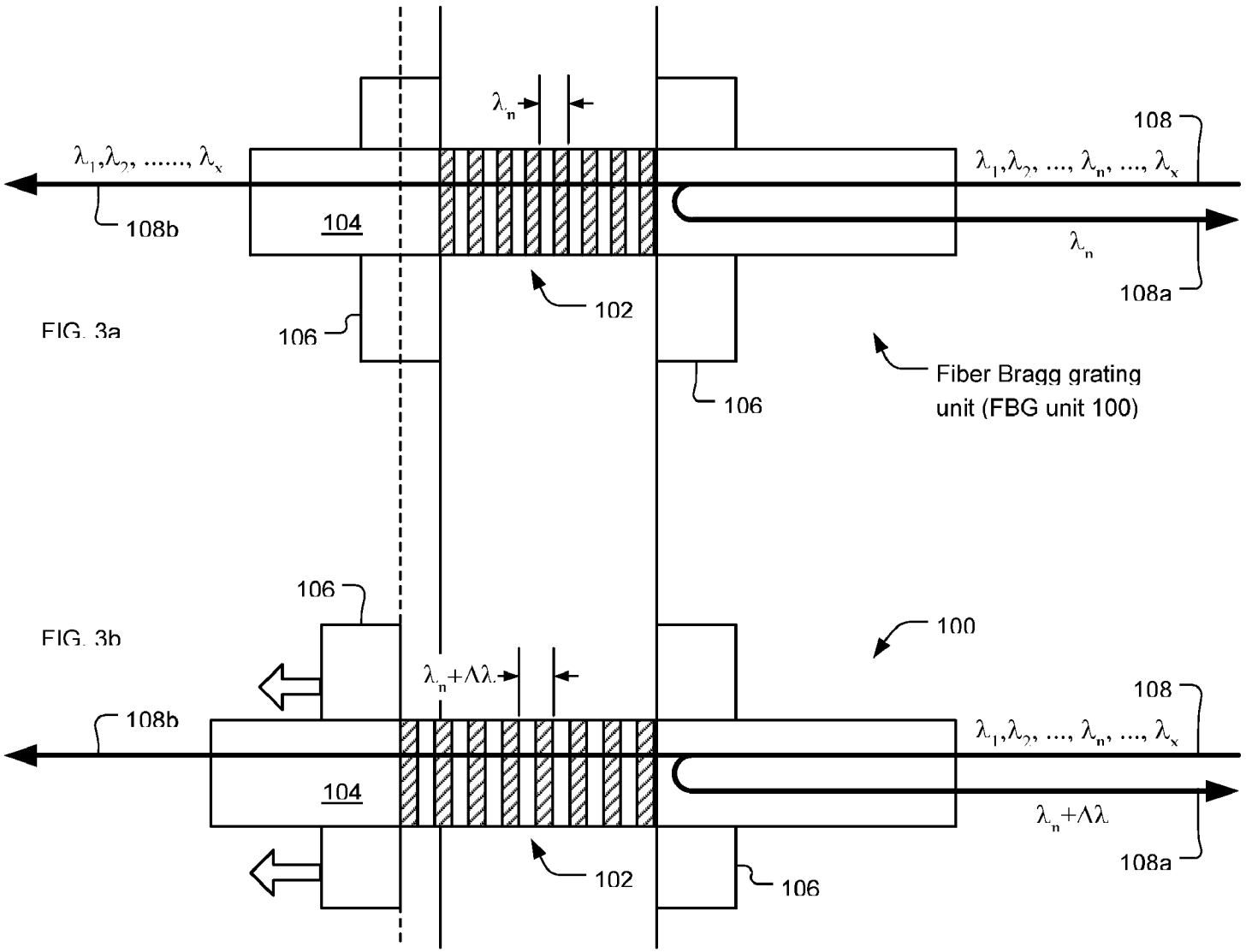

FIGS. 3*a-b* are simplified schematics depicting the structure and operation of a FBG unit 100 that can be used in fiber optic sensors 22*c* of the hazard mitigation system 10. FIG. 3*a* shows the FBG unit 100 before a force is exerted, and FIG. 3*b* shows the FBG unit 100 after the force is exerted.

For simplicity, the FBG unit 100 here is one having an FBG zone 102 that is integral to an optical fiber 104 held in mounting blocks 106. FBGs are frequently manufactured in optical fibers in this manner. Alternately, they can be discrete and then connected by optical fibers 104. In view of the total number and the typically different lengths of optical fiber needed, discrete FBGs with connecting optical fibers may be used in many embodiments of the hazard mitigation system 10. This is essentially a matter of design choice.

For use, a light source, usually a laser at the processor (see e.g., FIGS. 4-5, discussed presently), produces a light beam 108 having one or more light wavelengths, e.g., $\lambda_1, \lambda_2, \ldots \lambda_n \ldots \lambda_x$ in FIGS. 3*a-b*. For the hazard mitigation system 10 the FBG unit 100 is mounted to a structure so that it is initially in resonance with a wavelength in the light beam 108, e.g., $\lambda_n$. This light beam 108 is sent out via the optical fiber 104 to the FBG zone 102.

As summarized in FIGS. 3*a-b*, when a particular light wavelength is in resonance with a particular FBG zone 102 the portion of the light beam 108 of that wavelength ($\lambda_n$) is reflected back as a reflected beam 108*a* along the original path from which it came. Any other light wavelengths, e.g., $\lambda_1, \lambda_2, \ldots \lambda_x$, will not be in resonance and instead pass as a passed beam 108*b* through the FBG zone 102. If a beam splitter or coupler has been provided in the path of the original/reflected light (the beams 108, 108*a*), it can divert all or part of the reflected beam 108*a* to a photodetector, where a signal related to the light reflected in the particular FBG unit 100 is then produced. (See e.g., FIGS. 4-5.)

The phenomenon responsible for this follows the Bragg condition:

$$\lambda_B = 2n_{eff}\Lambda,$$

where $n_{eff}$ is the relative index of refraction between high (e.g., erbium doped) and low (the original optical fiber) materials. The physical length of the high-low period is $\Lambda$ and $\lambda_B$ is the resonant wavelength.

When the FBG unit 100 is stretched (or compressed) along its longitudinal direction (in FIG. 3*b* this is done by moving the left mounting block 106), $\Lambda$ changes accordingly. For example, assuming the stretch of the optical fiber 104 at the FBG zone 102 causes $\Lambda$ to change by 10-5, the resonant wavelength changes proportionally, which is equivalent to a 2 GHz shift in optical frequency. Such a significant shift can easily be detected. For instance, Fibera, Inc. of Santa Clara, Calif. makes equipment suitable for this. The present inventor has abundant experience producing fiber optic sensors that have sensitivity suitable to detect weight levels ranging from those of low-weight objects (e.g., a dog) to heavy objects (e.g., a truck).

Many track zones 12 experience wide variations in temperature, and the process of detecting objects with FBG units 100 will therefore often need to be temperature independent. Various approaches may be used to provide for this. Athermal FBGs are available and can be used, or non-athermal FBGs can be used and "normalized." For instance, the temperature can be conventionally measured and compensated for by the processor. Or two FBGs can be placed close together and used in a differential manner. Both FBG zones 102 are then equally effected by temperature but only one is stressed by the weight of an object 16, and any net difference between what is detected represents the weight of the object 16 in the track zone 12.

Accordingly, to employ its characteristic nature usefully here, a FBG unit 100 is arranged so that when an external longitudinal force is applied, the pitch of the FBG zone 102 changes and causes the resonance wavelength of the FBG unit 100 to also change. A detector then can detect this wavelength change and provides a signal that is representative of the magnitude of the change. In the case of the present invention, the source of the force is the weight of an object 16 in the track zone 12.

In many fiber optic sensor based configurations, it is desirable and can be expected that multiple sensors 22 will be used. The connection of the sensors 22 can then be in parallel, in a serial or "Daisy chain" configuration, or in various combinations of these. The inventor anticipates that in most cases both parallel and Daisy chain configurations will be used together, to make an overall configuration more effective.

Figure 4:
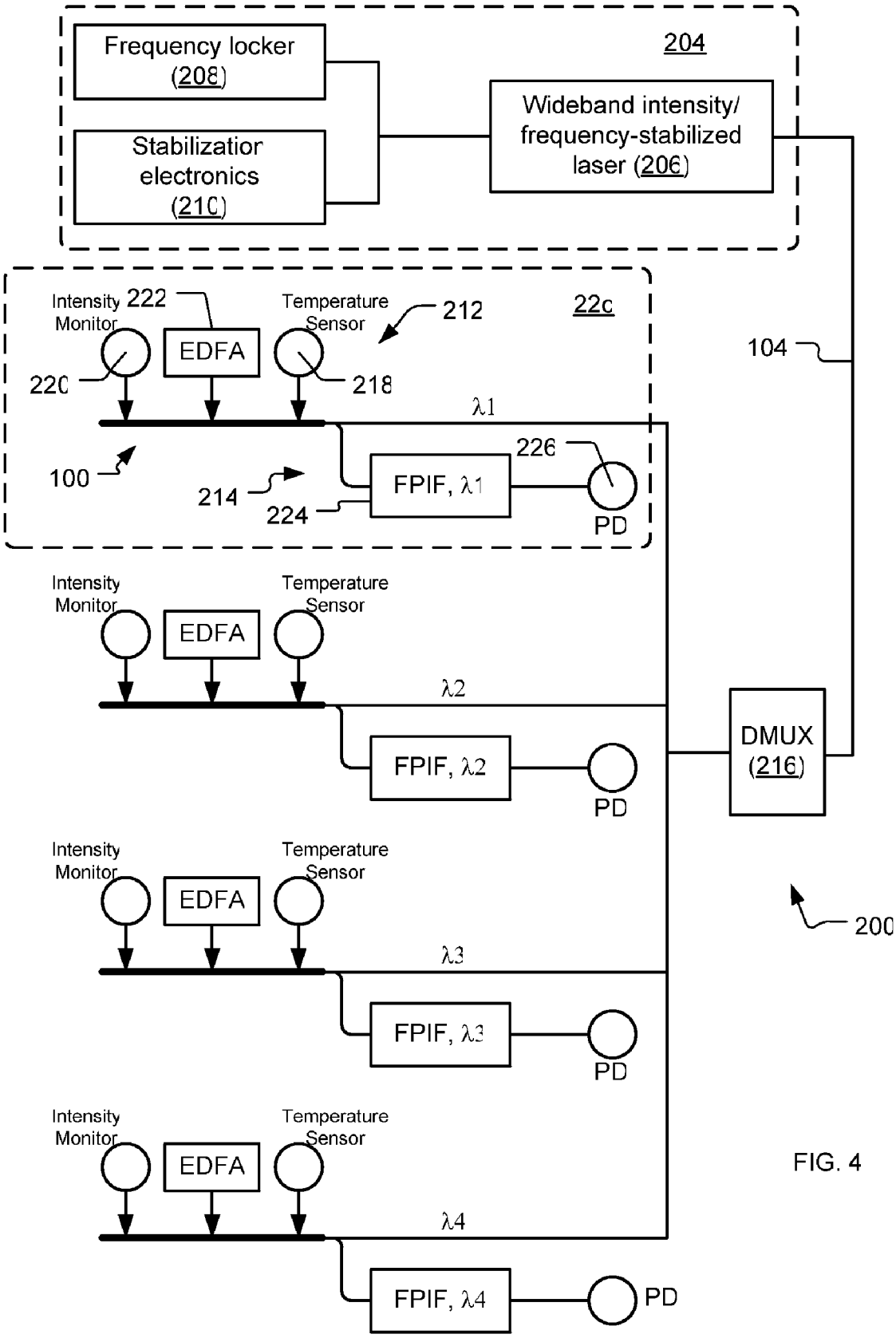
FIG. 4 is a schematic showing how an ensemble of fiber optic sensors based on FBG units can be connected in a parallel configuration.
Figure 5:
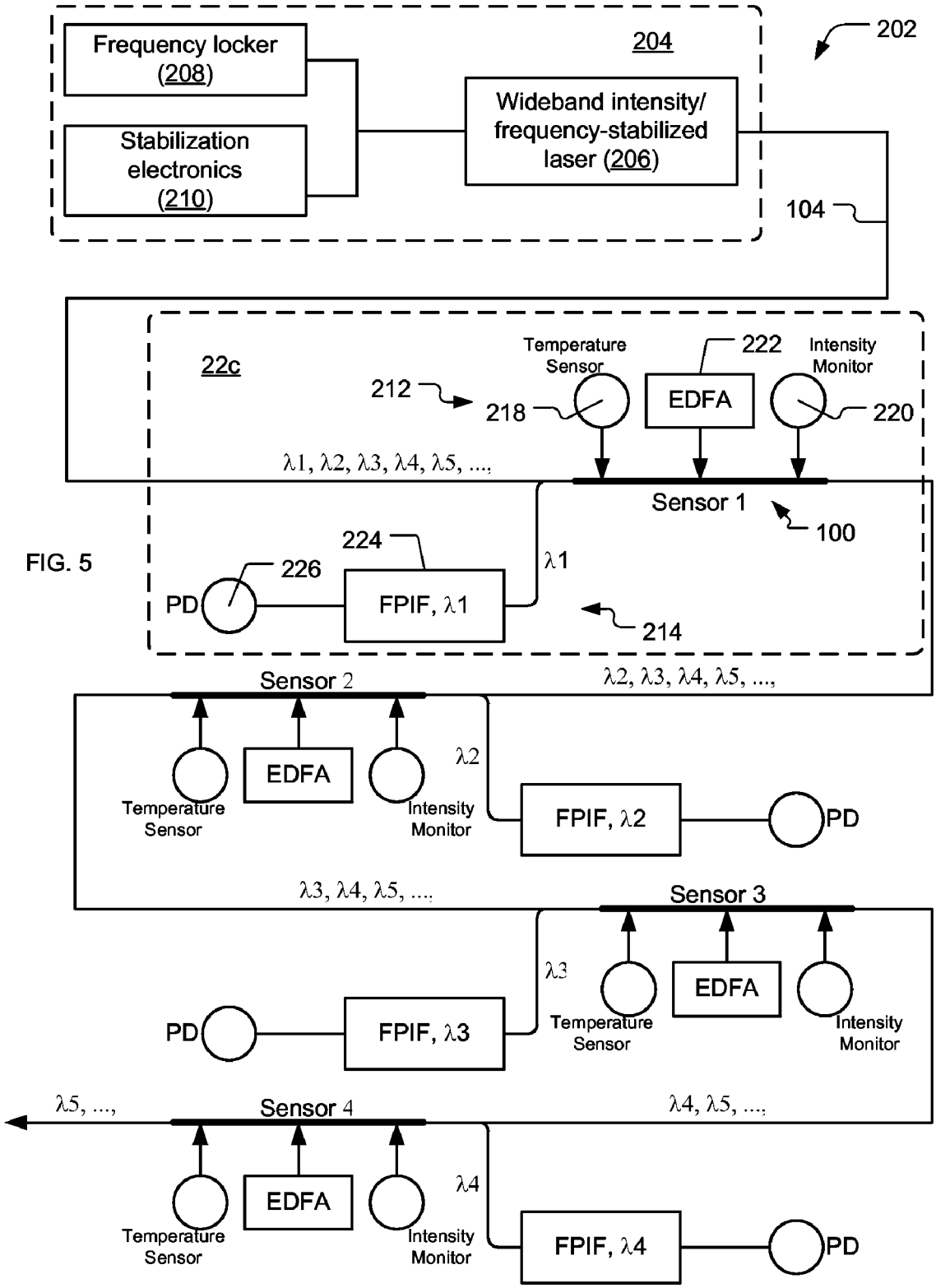
FIG. 5 is a schematic showing how an ensemble of fiber optic sensors based on FBG units can be connected in a serial or Daisy chain configuration.

FIG. 4 is a schematic showing how an ensemble of fiber optic sensors 22*c* based on FBG units 100 can be connected in parallel configuration 200, and FIG. 5 is a schematic showing how an ensemble of fiber optic sensors 22*c* based on FBG units 100 can be connected in a serial or Daisy chain configuration 202. These particular examples are of technology employed by the inventor in other applications and the sets of elements shown in these examples are not put forth as being novel. Rather, the present invention encompasses the application of sets of elements like those in FIGS. 4-5 in combination with the other elements and principles of operation set forth herein for the hazard mitigation system 10.

A light source 204 used in these particular examples is intensity and frequency stabilized, having a laser 206, a frequency locker 208, and a stabilization unit 210. The light source 204 provides light used by multiple sensor modules 212 and filter modules 214. In FIG. 4 a demultiplexer (DMUX 216) separates the multiple light wavelengths used. In the configuration in FIG. 5 such separation is not necessary. The sensor modules 212 here each consist of a FBG unit 100, a temperature sensor 218, an intensity monitor 220, and an erbium doped fiber amplifier (EDFA 222). The filter modules 214 here work in intensity mode, and each consists of a Fabry-Perot interference filter (FPIF 224) and a photodetector 226 (PD). The FPIF 224 is arranged to be in resonance with the frequency locker 208. Both the sensor modules 212 and the filter modules 214 here are sophisticated types that permit considerable correction for signal attenuation, variation, and degradation that are not attributable to the weight of an object 16, and thus permit determining the weight with a high degree of accuracy and reliability. In many applications, such degrees of accuracy may not be needed and simpler units can be used then.

II. The Structure at the Railway Track Zone.

FIGS. 6-7 are schematics showing some examples of structures at railway track zones 12 that are in accord with the present invention. As was done in FIG. 2, we again view the structure of a track zone 12 as consisting of a surface layer, a detection layer, and a foundation. The surface layer is the optional covering over the meshes 18 of wires 20 or optical fibers 104. Steel plate is just one material that can be used for this and the decision of material is purely one of practical design for the specific circumstances and can be made by a civil engineer; the detection layer consists of the meshes 18 and sensors 22; and the foundation is straightforward, being as its name implies, a support for the rest of the elements present.

Figure 6A:
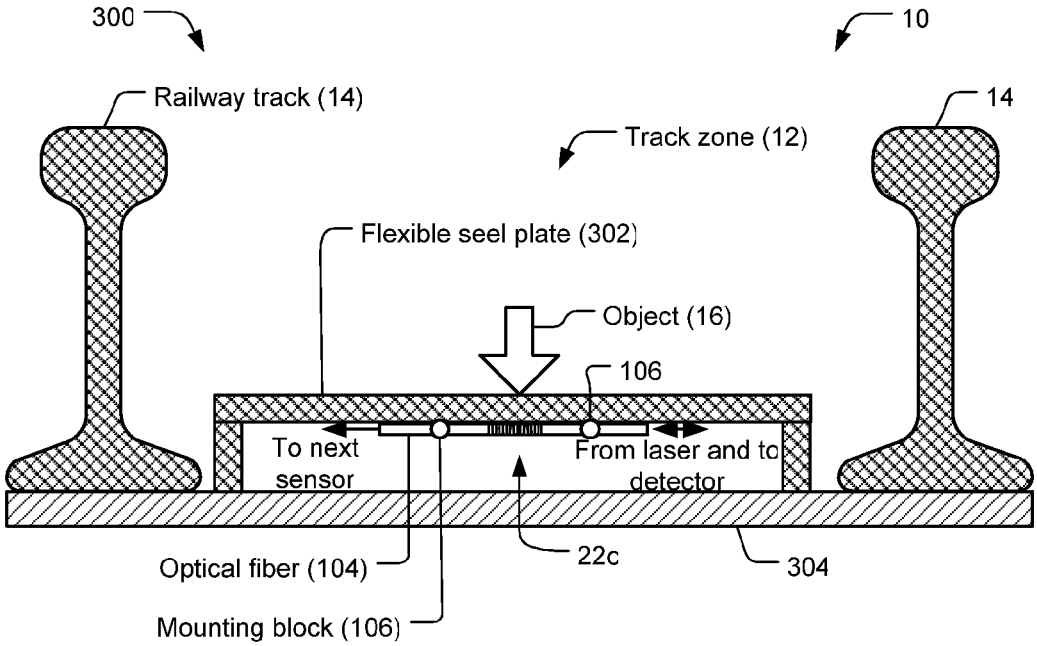
FIG. 6*a* is a schematic showing a simplified side cross-sectional view of a track zone structure that uses one or more fiber optic sensors.

FIG. 6*a* is a schematic showing a simplified side cross-sectional view of a track zone structure 300 that uses one or more fiber optic sensors 22*c*. The surface layer here includes a flexible steel top cover 302. The detection layer here includes the fiber optic sensors 22*c*, optical fibers 104 connecting them, and mounting blocks 106 attaching them to the top cover 302. And the foundation here is simply a main surface 304 that underlies the railway tracks 14 and the track zone 12.

Figure 6B:
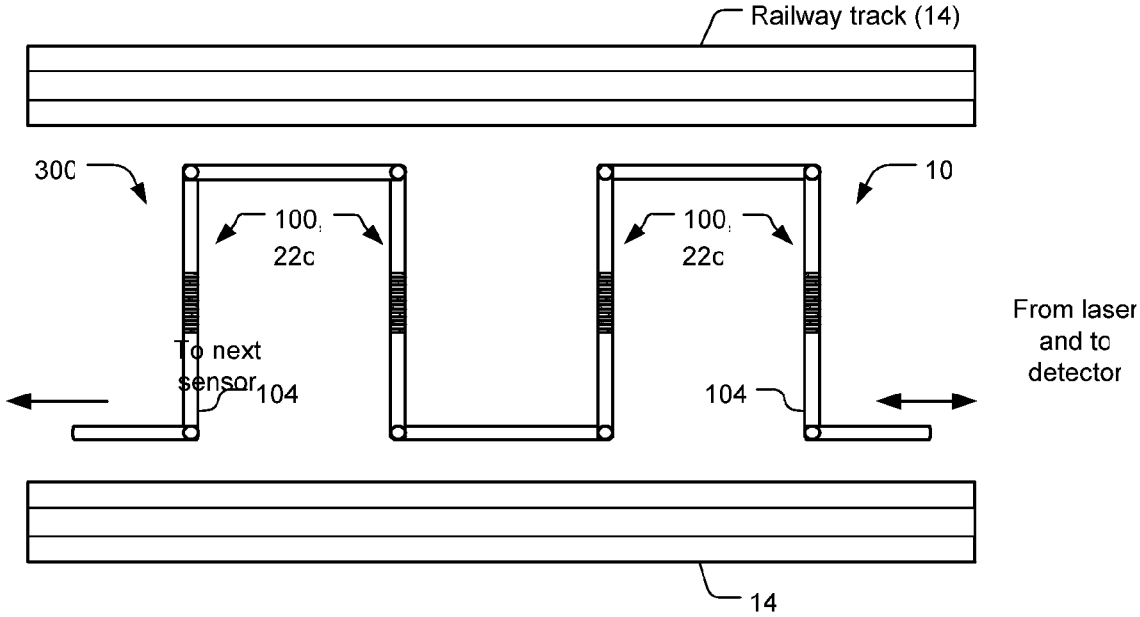
FIG. 6*b* shows a top plan view of the configuration in FIG. 6*a* with the top cover removed.

FIG. 6*b* shows a top plan view of the configuration in FIG. 6*a* with the top cover 302 removed. Here it can be seen how multiple fiber optic sensors 22*c* are used in a serial or Daisy chain configuration 202 like that depicted in FIG. 5. The fiber optic sensor employed is a FBG unit 100 mounted on the steel plate top cover 302. An adequate number of the fiber optic sensors 22*c* can be arranged and used such that their density permits determining an accurate location of a fallen object 16 an promptly reporting this to a train station master or train engineer.

Figure 7A:
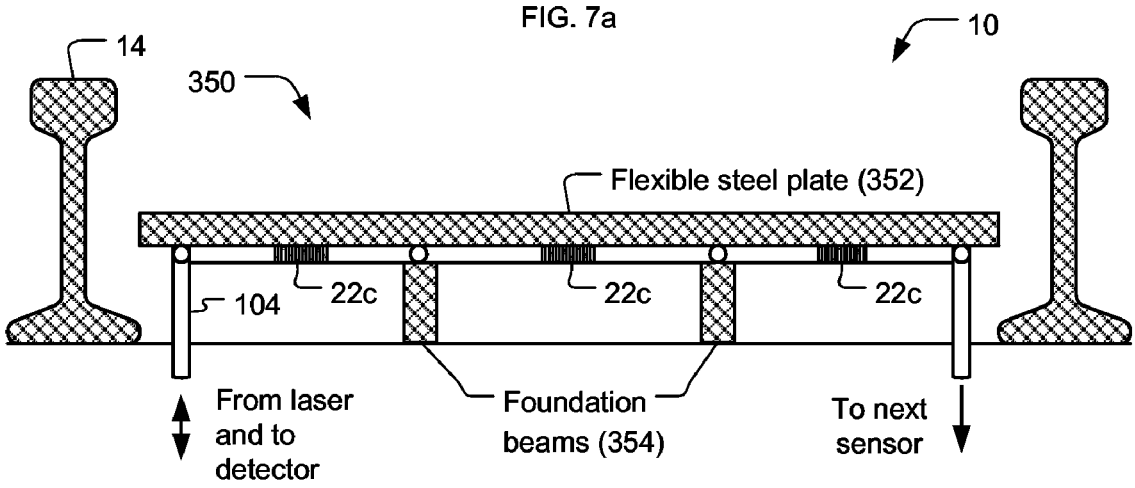
FIGS. 7*a-c* show before, during, and other during side cross-sectional views of a grade crossing structure that consists of a flexible steel plate that activates sensors when a load is applied by an object.
Figure 7B:
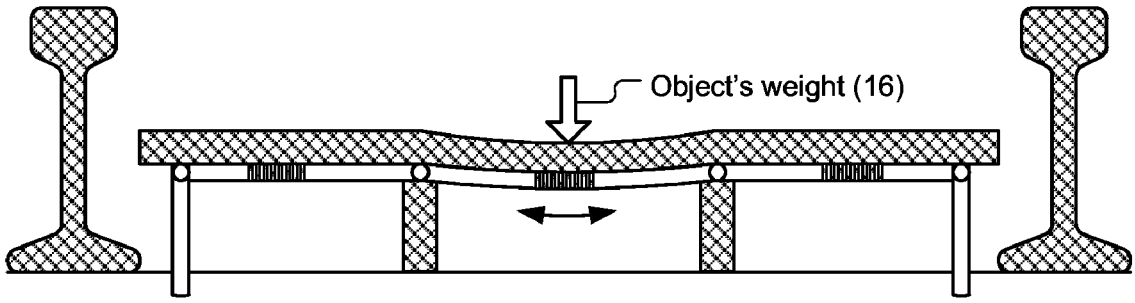
Figure 7C:
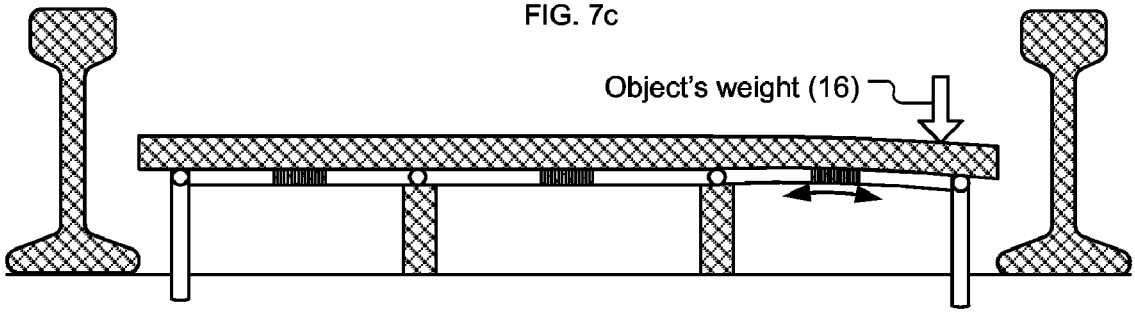

FIGS. 7*a-c* show before, during, and other during side cross-sectional views of a track zone structure 350 wherein a flexible steel plate 352 serves as the surface layer, multiple fiber optic sensors 22*c* are used in the detection layer (in another serial or Daisy chain configuration 202 like that depicted in FIG. 5), and solid steel beams 354 are used in the foundation. Of course, the surface layer can be of any material that suitably bends when a load is applied and the foundation can be of hollow steel tubing, concrete pylons, wooden posts, etc.

The detection layer in this embodiment of the hazard mitigation system 10 is essentially just the fiber optic sensors 22*c* attached to the steel plate 352. Bending at a local section of the steel plate 352 produces a strain at the local fiber optic sensor 22*c*, which changes its resonant wavelength in a detectable manner. A straightforward variation of this approach (not shown) is to instead attach the fiber optic sensors 22*c* to the beams 354 in the foundation in a manner that they are also stressed by sag of the plate 352.

Figure 8:
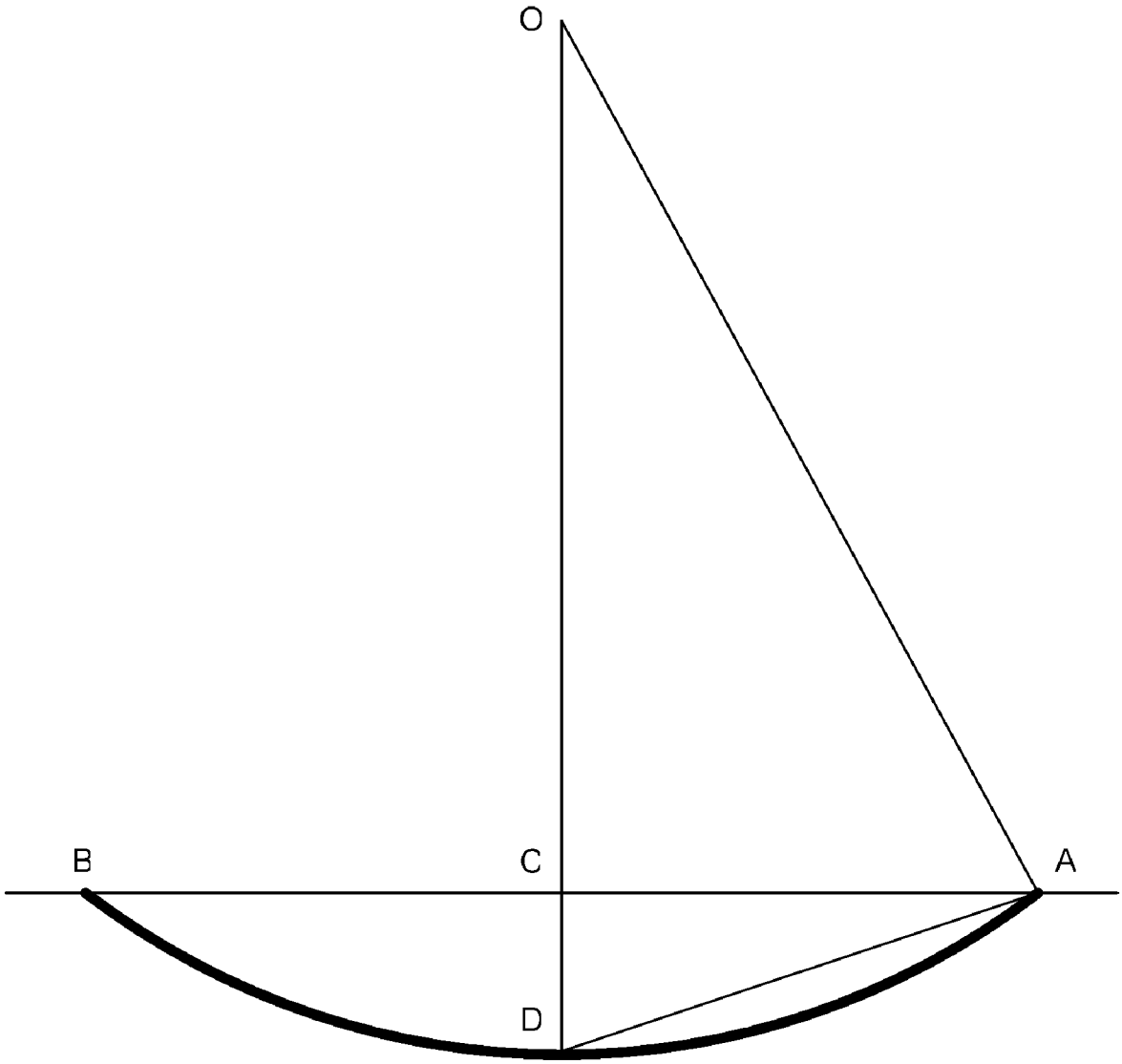
FIG. 8 presents a geometric representation of sagging at a grade crossing due to the weight of an object.

FIG. 8 presents a geometric representation of sagging at a track zone 12 due to the weight of an object 16. Assuming AB=5 m is the length of the section where a fiber optic sensor 22*c* is attached and is sagged by an amount of 2 mm from location C to location D. The length for the arc ADB can then be calculated as OD*2*arcsin(CD/AC)= AC^2*arcsin(CD/AC)/CD=5.0000016 meters. This means the pitch of the FBG zone 102 in the FBG unit 100 is stretched by 1.6*10^−6/5 =3.2*10^−7, which is a 64 Mhz frequency shift. This frequency shift can then be measured with suitable electronic circuitry. TABLE 1 shows the results of calculations of frequency shift for various mounted lengths vs. the amount of sagging.

III. The Signal Generation, Propagation, and Notification.

There are many advantages to using the fiber optic sensors 22*c*. The light beam 108 can propagate through optical fiber 104 for a very long distance without the need for repeaters. Signal propagation distances up to 100 kilometers have been demonstrated in the telecommunications industry. The fiber optic sensors 22*c* also do not generate any electrical interference that can affect train operation or communications. Similarly, unlike electrical type sensors, electrical systems on a train or otherwise present nearby do not affect the fiber optic sensors 22*c*. They function 24 hours a day, 7 days a week.

The use of an all-optical device makes fiber optic sensor based configurations of the hazard mitigation system 10 durable and reliable. The telecommunications industry has demonstrated that fiber optic signal transmission systems can have expected lifetimes of over 20 years. This makes fiber optic sensors 22*c* very attractive for monitoring at track zones 12 because it reduces the need for maintenance and repair.

FIG. 9 is a schematic showing a simplified top view of a complete exemplary configuration 400 of the inventive hazard mitigation system 10. A light beam is generated by a light source located in the card cage (control unit 402). The light source can be either a broadband light beam with its spectrum consisting of all the wavelengths of the various FBGs installed in the track zone 12, or it can be a narrow line-width tunable laser.

When a broadband light source (e.g., an LED) is used, all wavelengths are emitted simultaneously to pass through the optical fiber 104 and reach the installed fiber optic sensors 22*c*. Each FBG zone 102 therein then reflects light from within the provided spectrum at its resonant wavelength. In the return path, between the FBGs and a detector back in the control unit 402, a tunable filter is installed (see e.g., FIGS. 4-5). This tunable filter sweeps through the spectrum of the light source, and allow only one wavelength to pass at a time. Since the wavelength of each FBG unit 100 will have been recorded during installation, comparison by the processor of recorded information and detected signal magnitudes permits knowing the condition at each location where a FBG unit 100 is installed.

If a narrow line-width tunable laser is used, it is tuned through its light wavelength gain profile and light is reflected when the tuned wavelength comes into resonance with one of the installed FBG units 100. In both cases, the reflected light is detected by the detector or receiver, which is also located in the control unit 402.

The resonance wavelengths of the FBG units 100 are designed to be within the bandwidth of the light source spectrum. They are also adequately distinct from each other so there is no overlap during operation, with or without a load being present.

When an object 16 (human being, vehicle, animal, etc.) is in the track zone 12 its weight (gravity force) causes the detection layer to deform. The more weight present, the more deformation occurs. This deformation causes the pitches of the nearby FBG zones 102 to change, resulting in shifting of the resonant wavelengths of these FBG units 100. By comparing the amount of shift in a resonance wavelength from the reflected light, one can determine the estimated location and weight of the object 16.

This wavelength shift phenomenon can be expected to usually be sensed moving from one side of a track zone 12 to the other. If there is appreciable movement, the object 16 is probably a human being or an animal. If the movement stops in the middle of the track zone 12, however, something special is happening and it may be appropriate for the processor to issue a warning signal.

The preferred control unit 402 consists of a signal comparator, processor, data storage, weather station (optional), and data communications system. These can all be essentially conventional. The signal comparator evaluates the reflected wavelength from each fiber optic sensor 22*c* and compares it with information about the original resonance wavelength. If the difference is significant, a warning signal can be issued. The raw data of the reflected wavelengths is saved in the data storage for archive and possible later analysis purposes. The processor, typically a microprocessor, ensures that the light source is functioning properly; sets the intensity of the light source; sweeps the tunable filter if a broadband light source is used; sweeps the wavelength if a tunable laser is used; activates the data storage; issues a warning signal when the FBGs indicate the existence of an object in the grade crossing zone; acts on commands received from railway staff via a communications channel; and records temperature, humidity, and barometric pressure (if a weather station is installed). The data storage device can be a hard disc drive, a CD-R, DVD-R or other optically writable drive, or any suitable data storage unit able to reliable handle data at the expected rate and quantity needed here. The weather station can include any or all of the following: temperature sensors, humidity sensors, barometric pressure sensors, and rain gauges. The data communications system can be any appropriate telecom transmission device, and can be wireless if desired. The purpose of this communications system is to allow the railway staff or other appropriate parties to review the condition of each track zone 12, to issue commends to and monitor each processor at particular stations, and to permit the retrieval of data from potentially many grade crossing locations.

There are several ways warning signal notification can be achieved. The simplest way is already widely used in the railway industry. As shown in FIG. 9, warning lights 404 can be installed at designated locations. Such warning lights 404 installed at more than one distances from the track zone 12 can be used so that various levels of urgency can be observed by a train engineer or station master. The warning lights 404 can be arranged similar to street stoplights for automobiles. A green light at the first tier observing position can indicate that a track zone 12 is clear, and that the train can proceed at full speed. A yellow light at the same location can indicate that an object 16 is passing through the track zone 12 but with adequate speed to be clear when the train actually approaches the track zone 12. And a red light at the same location can indicate that an object 16 is blocking or stationary in the track zone 12.

At a closer observing position (a second tier observation position), even a moving object 16 without adequate speed can trigger the red light warning to the train engineer to stop the train. With appropriate selection of distances, this will provide adequate braking distance for the train to fully stop before reaching the track zone 12. In sum, the use of multiple tiers of observation positions gives the train engineer abundant opportunities to evaluate the safety condition at a track zone 12 and to take proper action before arriving there.

The control unit 402 (e.g., in a card cage) can be installed either near a track zone 12 or elsewhere in a train station. In many cases, electrical power for the inventive hazard mitigation system 10 can be acquired from a power source already present for another purpose. Of course, the control unit 402 even can be made quite compact or can be integrated with other railway control systems.

More sophisticated notification mechanisms may be used in the hazard mitigation system 10, including ones that can send warning signals to the train engineer via a wireless telephone device, or send the warning to a nearby train station to let the station controller issue a warning signal to the train engineer. All these mechanisms can be used and are mainly dependent on the budget of the train company or government body responsible for railway track zone safety.

Since this invention depends on the weight of the object 16, it is not affected by weather conditions. It is also durable and reliable. More importantly, its implementation is simple and its installation and upkeep should easily be within the capability of ordinary railway maintenance workers.

While various embodiments have been described above, it should be understood that they have been presented by way of example only, and not limitation. Thus, the breadth and scope of the invention should not be limited by any of the above described exemplary embodiments, but should be defined only in accordance with the following claims and their equivalents.

What is claimed is:

1. A system for hazard mitigation related to an object intruding into a track zone at a train station platform, comprising:

a structure including a fixed foundation and a surface layer cushionably placed above said foundation, wherein said structure is located in the track zone;

at least one sensor mounted between said surface layer and said foundation, wherein said sensor senses the weight of the object upon said surface layer and provides a sensor signal representative of said weight; and a control unit to receive said sensor signal, to process said sensor signal to determine whether the object represents a potential hazard, and, if so to generate a warning signal.

2. The system of claim 1, wherein said sensor includes a strain gauge.

3. The system of claim 2, wherein said strain gauge is fixedly mounted with respect to said foundation and said sensor further includes a tension wire fixedly connected at one end and at the other end to said strain gauge such that movement of said surface layer due to the weight of the object activates said sensor to provide said sensor signal.

4. The system of claim 3, wherein said tension wire is of a low thermal expansion material.

5. The system of claim 1, wherein said sensor includes a pressure gauge.

6. The system of claim 1, wherein:

said sensor includes a fiber optic sensor; and said control unit includes a light source to provide a light beam to said sensor, wherein said light beam includes at least one wavelength chosen based on a response characteristic of said fiber optic sensor.

7. The system of claim 6, wherein said fiber optic sensor is a member of the set consisting of athermal type devices and devices having a normalizing mechanism that compensates for temperature variation.

8. The system of claim 6, wherein:

multiple said sensors are employed in the system; and said multiple said sensors are interconnected with optical fiber in a configuration that is a member of the set consisting of serial connections, parallel connections, and combinations thereof.

9. The system of claim 8, wherein said light source includes a narrow line-width tunable laser.

10. The system of claim 8, wherein said light source provides said light beam having a broadband spectrum of wavelengths consisting of all the wavelengths of said multiple said sensors.

11. The system of claim 6, wherein said fiber optic sensor includes at least one member of the set consisting of Fabry-Perot gratings, Mach-Zehnder interferometers, Fizeau interferometers, and Michelson interferometers.

12. The system of claim 6, wherein said fiber optic sensor includes a fiber Bragg grating.

13. The system of claim 1, wherein:

said control unit includes a signal comparator, a processor, a data storage, and a communications system; and wherein said signal comparator evaluates said sensor signal based on pre-stored data in said data storage; and said control unit directs said signal comparator, monitors said sensor signal, determines whether the object represents a potential hazard based on externally obtained contemporaneous information about the track zone, generates said warning signal, and directs said communications system to externally communicate said warning signal, thereby permitting a human operator or an automated system to act based on said warning signal.

14. The system of claim 13, wherein said control unit further includes a weather station including at least one member of the set consisting of temperature sensors, humidity sensors, barometric pressure sensors, and rain gauges.

15. The system of claim 13, wherein said communications system includes a wireless telecommunications device.

* * * * *